US008231445B2

(12) United States Patent
Lomax, Jr. et al.

(10) Patent No.: US 8,231,445 B2
(45) Date of Patent: Jul. 31, 2012

(54) APPARATUS AND METHOD FOR PROVIDING DETONATION DAMAGE RESISTANCE IN DUCTWORK

(75) Inventors: Franklin D. Lomax, Jr., Falls Church, VA (US); Christopher H. Van Dyke, Washington, DC (US); Edward T. McCullough, Dallas, TX (US); Daniel A. Evbota, Beltsville, MD (US); Ronak A. Patel, Reisterstown, MD (US)

(73) Assignee: L'Air Liquide Societe Anonyme pour l'Etude Et l'Exploitation des Procedes Georges Claude, Paris (FR)

( * ) Notice: Subject to any disclaimer, the term of this patent is extended or adjusted under 35 U.S.C. 154(b) by 1074 days.

(21) Appl. No.: 11/780,922

(22) Filed: Jul. 20, 2007

(65) Prior Publication Data

US 2009/0023375 A1 Jan. 22, 2009

(51) Int. Cl.
*E04H 9/00* (2006.01)
*F16L 9/128* (2006.01)

(52) U.S. Cl. ..... 454/194; 138/172

(58) Field of Classification Search ..... 454/194
See application file for complete search history.

(56) References Cited

U.S. PATENT DOCUMENTS

| | | | | | |
|---|---|---|---|---|---|
| 1,049,543 | A | | 1/1913 | Smith | |
| 1,416,334 | A | * | 5/1922 | Connery | 285/399 |
| 1,666,303 | A | * | 4/1928 | Platt | 109/21.5 |
| 2,036,773 | A | * | 4/1936 | Prudden | 138/128 |
| 2,392,215 | A | * | 1/1946 | Abrams et al. | 109/85 |
| 2,687,876 | A | | 8/1954 | Hytte | |
| 2,853,147 | A | * | 9/1958 | Eustachio | 181/224 |
| 2,911,011 | A | | 11/1959 | Neihart | |
| 2,974,745 | A | * | 3/1961 | Kristiansen | 181/224 |
| 3,018,840 | A | * | 1/1962 | Bourne et al. | 181/224 |
| 3,202,184 | A | * | 8/1965 | Godshalk | 138/172 |
| 3,490,521 | A | * | 1/1970 | Byerley | 165/158 |
| 4,007,908 | A | * | 2/1977 | Smagghe et al. | 251/127 |
| 4,325,171 | A | * | 4/1982 | Nobles | 29/890.04 |
| 4,357,306 | A | * | 11/1982 | Takacs et al. | 422/254 |
| 4,582,044 | A | * | 4/1986 | Ferguson et al. | 126/289 |
| 4,938,247 | A | * | 7/1990 | Yandle, II | 137/68.23 |
| 5,207,386 | A | * | 5/1993 | Mehoudar | 239/542 |
| 6,116,833 | A | * | 9/2000 | Ellis | 411/384 |
| 6,382,233 | B1 | * | 5/2002 | Yandle, II | 137/68.23 |
| 7,322,381 | B2 | * | 1/2008 | Kino et al. | 138/157 |
| 7,603,959 | B1 | * | 10/2009 | Veazey | 114/263 |
| 7,762,205 | B1 | * | 7/2010 | Veazey | 114/267 |
| 8,061,476 | B2 | * | 11/2011 | Corin | 181/224 |
| 2008/0012342 | A1 | * | 1/2008 | Elliott et al. | 285/424 |
| 2009/0318072 | A1 | * | 12/2009 | Perera | 454/194 |

* cited by examiner

*Primary Examiner* — Steven B McAllister
*Assistant Examiner* — Frances H Kamps
(74) *Attorney, Agent, or Firm* — Elwood L. Haynes

(57) ABSTRACT

A ductwork system including a duct having a plurality of ducting panels joined together to define a flow passage extending therethrough, and the duct having structure for resisting damage thereto caused by a detonation within the duct. The structure for resisting damage can include an internal bracing within and extending across the flow passage of the duct to tie at least two sides of the duct together. For example, the internal bracing can be a reinforcement panel including a mounting frame with one or more elongated members extending from one side of the frame attached to a ducting panel to another side of the frame attached to an opposite ducting panel. Alternatively or in addition to the above structure, the duct can have structure for resisting damage that includes providing the duct with at least one curved or faceted side along an axial length of the duct.

12 Claims, 7 Drawing Sheets

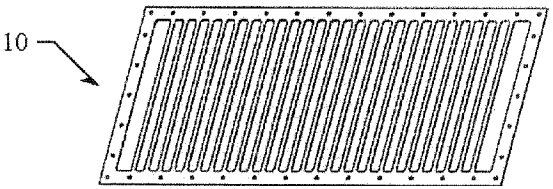
FIG. 1C
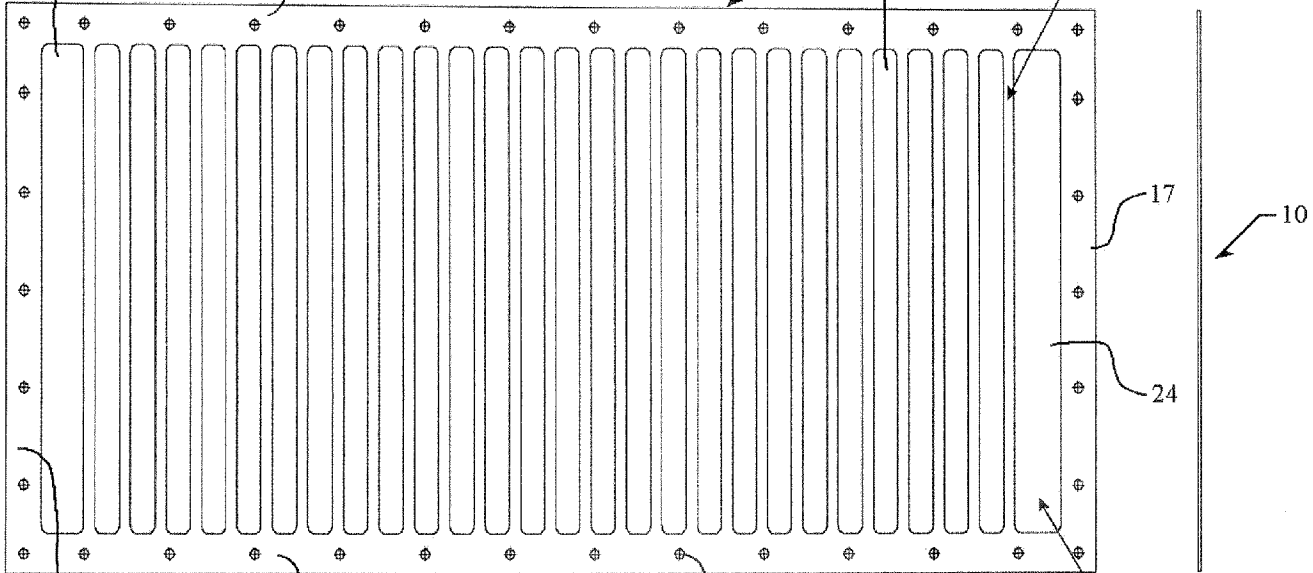
FIG. 1B
FIG. 1A

APPARATUS AND METHOD FOR PROVIDING DETONATION DAMAGE RESISTANCE IN DUCTWORK

BACKGROUND OF THE INVENTION

1. Field of the Invention

The present invention relates to ductwork for carrying a fluid flow.

2. Discussion of the Background

Ductwork used to carry fluid at high temperatures is subject to stresses due to thermal expansion of the ductwork and/or other components housed within the ductwork. Additionally, in certain applications, the ductwork can be subject to detonation of fuel that is either intentionally or accidentally flowing within the ductwork. For example, if fuel accidentally flows within the ductwork and high temperature conditions are present within the ductwork such that the fuel is raised to a temperature above the auto-ignition temperature of the fuel, then the fuel could detonate within the ductwork. Such a detonation could result in irreversible damage to the ductwork, and could cause harm to people or structures near the ductwork at the time of the detonation.

BRIEF SUMMARY OF THE INVENTION

In an effort to eliminate the above problems associated with ductwork used in high temperature applications, the inventors of the present invention have developed an apparatus and method of providing detonation damage resistance in ductwork, as is described below.

The present invention advantageously provides a ductwork system including a duct having a plurality of ducting panels joined together to define a flow passage extending therethrough, where the duct is provided with structure for resisting damage thereto caused by a detonation within the duct.

In a first aspect of the invention, a structure is provided for resisting damage that includes an internal bracing within and extending across the flow passage of the duct to tie at least two sides of the duct together. An example of such an internal bracing is a reinforcement panel including a mounting frame with one or more elongated members extending from one side of the frame attached to a ducting panel to another side of the frame attached to an opposite ducting panel.

In a second aspect of the invention, which can be implemented as an alternative to or in addition to the structure in the first aspect of the invention, the duct has structure for resisting damage that includes providing the duct with at least one curved or faceted side along an axial length of the duct.

BRIEF DESCRIPTION OF THE DRAWINGS

A more complete appreciation of the invention and many of the attendant advantages thereof will become readily apparent with reference to the following detailed description, particularly when considered in conjunction with the accompanying drawings, in which:

FIG. 1A depicts a plan view of a reinforcement panel according to the present invention for use in ductwork to resist detonation damage to the ductwork;

FIG. 1B depicts a side view of the reinforcement panel of FIG. 1A;

FIG. 1C depicts a reduced, perspective view of the reinforcement panel of FIG. 1A;

DETAILED DESCRIPTION OF THE INVENTION

Figure 2:
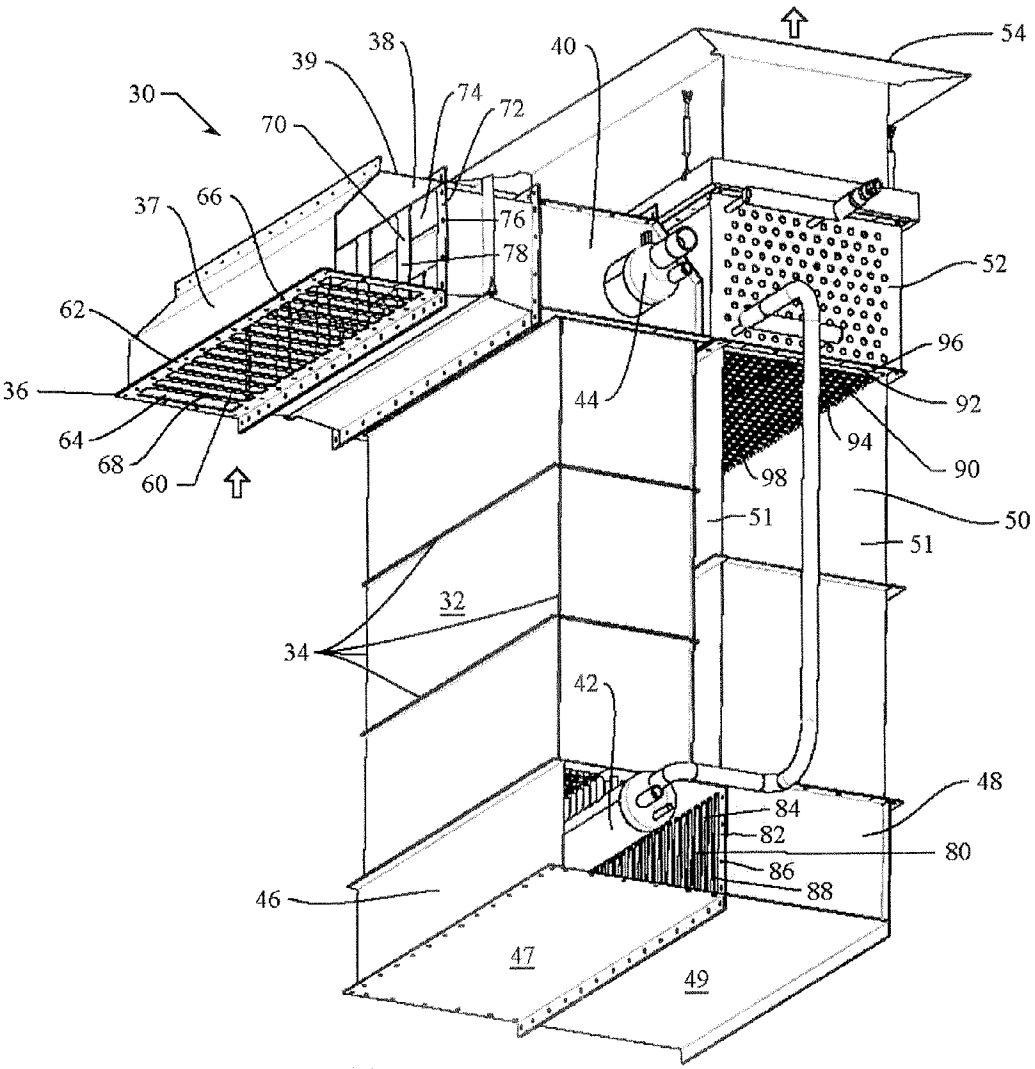
FIG. 2 depicts a perspective view (shown with some front panels removed to reveal interior structures) of a ductwork system of the present invention including several reinforcement panels provided at various locations within a flow path of the ductwork where a risk of detonation exists.

Embodiments of the present invention are described hereinafter with reference to the accompanying drawings. In the following description, the constituent elements having substantially the same function and arrangement are denoted by the same reference numerals, and repetitive descriptions will be made only when necessary.

The inventors have determined that when designing ductwork many factors must be taken into account, such as the cost of manufacture and assembly of such ductwork, as well as structural requirements of the ductwork system. Thus, the ductwork configuration and the type of material used to construct the ductwork can be selected based on such factors as the cost of the material, the strength of the material, the amount of material needed to satisfy strength requirements of the ductwork, the reaction of the material to the conditions in which the material will be used, the weight of the material, the ease and costs associated with manufacturing and assembling the ductwork using that material, etc. However, simply providing relatively thick walls in order to provide resistance to detonation damage is not typically advantageous due to the increase in cost and weight of the ductwork. Further, ductwork of extreme thickness disadvantageously has low flexibility. In high temperature applications where temperature gradients exist, such as in heat exchangers and heat exchange reactors it is desirable that the ductwork be flexible as well as strong in order to prevent mechanical failure due to thermal stresses. Also, the inventors have determined that the use of external braces and supports to provide detonation damage resistance for the ductwork is not typically advantageous, since such external braces and supports may be at a lower temperature than the ductwork which could result in thermal expansion problems caused by the uneven expansion of the external braces and supports relative to the ductwork.

The present invention advantageously provides apparatuses and methods to significantly reduce or entirely eliminate damage caused by a detonation within ductwork without the need for providing overly thick walls or external bracing unless such features are otherwise desirable for use therewith. While the present invention is not limited to the configurations of the preferred embodiments described and depicted herein, the preferred embodiments of the present invention use thin, flexible walls of sheet metal in order to withstand stresses caused by thermal expansion, while yet still maintaining a lightweight ductwork configuration, which is flexible and can accommodate substantial temperature gradients without developing undue thermal stresses.

In a first aspect of the present invention, the invention provides an internal bracing that extends across a flow passage of the ductwork in order to provide a reinforcement structure to resist outward forces acting on walls of the ductwork caused by a detonation within that flow passage. For example, such an internal bracing can be an elongated member having a first end attached in any manner to a wall of the ductwork and a second end attached in any manner to an opposite wall of the ductwork. Thus, if a detonation occurs within the flow passage, then the elongated member will provide resistance to the outward forces from the detonation along the length of the elongated member (e.g., the elongated member will be in tension), thereby holding the opposing walls of the ductwork together and preventing damage to the walls.

The internal bracing of the present invention can take many forms and can be attached to the ductwork in many different ways, the preferred embodiments of which are set forth below. For example, the internal bracing can be provided in a reinforcement panel having an outer mounting frame and one or more elongated members extending in one or more directions across an opening through the frame (e.g., plural elongated member in a parallel or a non-parallel arrangement, plural elongated members in a crossing (or grid or net) pattern in a perpendicular arrangement or a non-perpendicular arrangement, etc.). The internal bracing can be elongated members connected to or integrally part of baffle plates in the flow passage of the ductwork. (See, e.g., FIG. 4.) The internal bracing is preferably positioned at locations within the ductwork where detonation can occur, and oriented within the ductwork to provide resistance to the forces acting on weak portion of the ductwork (e.g., one or more the elongated members can be attached between a weak outer panel or joint of the ductwork and the opposing outer panel or joint to resist the outward forces from the detonation acting on the weak outer panel or joint). The internal bracing also preferably does not significantly hinder fluid flow through the flow passage of the ductwork.

FIG. 1A depicts a plan view of a reinforcement panel according to the present invention for use in ductwork to resist detonation damage to the ductwork, and FIGS. 1B and 1C depict a side view and reduced perspective view thereof, respectively. In this embodiment, the internal bracing is provided in the form of a reinforcement panel 10 constructed from a planar sheet of metal, such as stainless steel or nickel superalloy sheet metal. The reinforcement panel 10 includes a mounting portion (or outer mounting frame) 12 with an opening 13 extending through the central portion of the frame 12. The frame 12 has four side portions 14-17 along the perimeter thereof.

In this embodiment, each of the side portions 14-17 are configured to be clamped and sandwiched between adjacent sections of ducting panels at a joint between the adjacent sections of ducting panels, and mounted to the ducting panels. The side portions 14-17 can be mounted to the ducting panels using, for example, a plurality of mounting holes 18 that are provided about the perimeter of the frame 12, and providing, for example, bolt-and-nut fasteners through the mounting holes and corresponding mounting holes on the ducting panels. Additionally or alternatively, adjacent edges of the frame 12 and ducting panels can be welded together to provide further structural connection therebetween. Alternatively to the above mounting of the frame 12, the frame 12 can be directly attached to an inner surface of the ductwork at any position along the flow path, for example, by welding or other mounting structure or method, and can be provided at or adjacent to a joint or at any other location along the length of the flow path.

In the reinforcement panel 10 depicted in FIGS. 1A-1C, a plurality of elongated members (or fingers) 20 extend in parallel to one another across the opening 13 through the frame 12, and fluid flow openings 22 are thus defined between the elongated members 20. In the embodiment depicted in FIGS. 1A-1C, elongated fluid flow openings 24 are also provided between the end elongated members adjacent to side portions 16 and 17. In this embodiment, the elongated members 20 each have a first end integrally connected to the side portion 14, which acts as a base portion, and a second end integrally connected to the side portion 15, which acts as a base portion and is provided opposite to the side portion 14. The number and configuration of the elongated members 20 will be dependent upon a balance between the strength requirements needed to resist detonation forces at that location in the flow passage and the flow requirements through that location of the flow passage in view of the hindrance to the fluid flow that will be caused by the elongated members.

Numerous different configurations of the internal bracing are possible. For example, the internal bracing can be constructed to include numerous different configurations of one or more of the elongated members 20. The elongated members 20 can be provided across the entire opening, the members 20 can be provided across only a portion of the opening, the members 20 can be evenly spaced apart from one another, the members can be provided with different spacings therebetween, the members 20 can include a combination of evenly spaced and non-evenly spaced elongated members, etc. Additionally, the elongated members 20 can be provided with the same shape, cross-section, and size, with different shapes, cross-sections, and sizes, or any combination thereof. The elongated members 20 can be formed of the same material or material properties, or different materials or material properties. Also, elongated members can also be provided that extend in one or more directions across the opening that are different than elongated members 20 in FIGS. 1A-1C, for example, parallel and/or a non-parallel arrangements of additional elongated members, in a crossing (or grid or net) pattern in a perpendicular arrangement or a non-perpendicular arrangement, etc.

The reinforcement panel 10 is preferably mounted at a location within the ductwork where there is a risk that detonation will occur, and the reinforcement panel is preferably mounted within the ductwork in an orientation that provides resistance to detonation forces acting on a weak portion of the ductwork at that location. For example, the reinforcement panel 10 depicted in FIGS. 1A-1C is preferably oriented and mounted within the ductwork such that side portion 14 and/or side portion 15 is attached to a weak portion or portions of the ductwork, so that the elongated members 20 extending therebetween can provide resistance to the detonation forces acting on the weak portion(s).

FIG. 2 depicts a perspective view of a ductwork system 30 of the present invention including several different reinforcement panels 60, 70, 80, 90 provided at various locations within a flow path of the ductwork where a risk of detonation exists. In this case the ductwork is used for a steam generator. Some front panels of the ductwork depicted in FIG. 2 have been removed to reveal the reinforcement panels provided within the interior of the ductwork.

The ductwork system 30 depicted in FIG. 2 includes an inlet 36 that receives, for example, hot exhaust gas from a hydrocarbon steam reformer or other device. The hot exhaust gas enters the ductwork system 30 by flowing upward through the inlet 36 and the gas is thereby received within a flow passage in duct section 38 (shown with the front ducting panel thereof removed to reveal reinforcement panels 60 and 70). The gas then travels horizontally along the flow passage to duct section 40, where the gas flow turns downward and travels shell-side over an evaporator, which has a separate tube-side flow between an inlet manifold 42 to an outlet manifold 44. Thus, the gas travels downward from duct section 40 to duct section 46 (shown with the front ducting panel thereof removed to reveal reinforcement panel 80), where the gas turns and flows horizontally to duct section 48, where the gas turns and flows upward through duct section 50 (shown with the front ducting panel thereof removed to reveal reinforcement panel 90) and then through economizer section 52 to outlet 54, where the gas is discharged from the ductwork system 30.

The ductwork of the ductwork system 30 is constructed using ducting panels 32 of different shapes and sizes, but which are typically formed from sheet metal plates with folded ends 34 that are used to join together adjacent panels, for example, by using bolt-and-nut fasteners through mounting holes in the ends of the panels and/or by welding together abutting edges of adjacent panels. This embodiment of the present invention uses ducting panels 32 that provide thin, flexible walls that withstand stresses caused by thermal expansion, and advantageously provide a lightweight ductwork configuration. However, certain sections of the ductwork may be at risk for detonation of fuel within the gas in the flow passage, and therefore these sections of the ductwork may be susceptible to irreversible mechanical damage to the ductwork caused by such detonations. Therefore, in order to significantly reduce or entirely eliminate damage caused by such a detonation within ductwork, the ductwork system 30 depicted in FIG. 2 includes several reinforcement panels 60, 70, 80, and 90 mounted within the ductwork in orientations that provide resistance to detonation forces acting on weak portions of the ductwork at the locations at risk for detonations.

Reinforcement panel 60 includes a mounting portion (or outer mounting frame) 62 with an opening 64 extending through the frame 62. A plurality of mounting holes 66 are provided about the perimeter of the frame 62, and are used with bolt-and-nut fasteners to mount the frame 62 to the adjacent ducting panels. A plurality of elongated members 68 extend in parallel to one another across the opening 64. The panel 60 is oriented such that the elongated members 68 are oriented to provide detonation resistance to, for example, panel 37 of duct section 38 (and/or panels adjacent thereto), which is at risk of have a detonation therein. The configuration and number of elongated members 68 are determined based upon the strength requirements of the internal bracing and the flow requirements through the flow passage at this location in the ductwork.

Reinforcement panel 70 includes a mounting portion (or outer mounting frame) 72 with an opening 74, a plurality of mounting holes 76, and a plurality of elongated members 78. The panel 70 is oriented such that the elongated members 78 are oriented to provide detonation resistance to, for example, panel 39 of duct section 38 (and/or panels adjacent thereto), which is at risk of have a detonation therein. The configuration and number of elongated members 78 are determined based upon the strength requirements of the internal bracing and the flow requirements through the flow passage at this location in the ductwork.

Reinforcement panel 80 includes a mounting portion (or outer mounting frame) 82 with an opening 84, a plurality of mounting holes 86, and a plurality of elongated members 88. The panel 80 is oriented such that the elongated members 88 are oriented to provide detonation resistance to, for example, panel 47 of duct section 46 and/or panel 49 of duct section 48 (and/or other adjacent panels), which are at risk of have a detonation therein and form (panel 47 and panel 49 together) a long, flat, otherwise unsupported surface that is very susceptible to damage from a detonation. The configuration and number of elongated members 88 are determined based upon the strength requirements of the internal bracing and the flow requirements through the flow passage at this location in the ductwork.

Reinforcement panel 90 includes a mounting portion (or outer mounting frame) 92 with an opening 94, a plurality of mounting holes 96, and a grid of perpendicularly crossing elongated members 98. The panel 90 is provided with the grid of perpendicularly crossing elongated members 98 that are oriented to provide detonation resistance to, for example, all four panels 51 around the perimeter of duct section 50 and/or the panels around the perimeter of the economizer section 52, which are at risk of having a detonation therein and are otherwise unsupported surfaces that are susceptible to damage from a detonation. The configuration and number of elongated members 98 are determined based upon the strength requirements of the internal bracing and the flow requirements through the flow passage at this location in the ductwork.

The present invention provides a method and structure for providing detonation damage resistance to ductwork in which one aspect of the invention provides internal braces or supports to tie the ducting panels of the ductwork together in order to significantly reduce damage thereto caused by a detonation within the ductwork. Since detonations apply forces in opposing directions on opposite sides of the ducting, the internal bracing, which is sufficiently strong to resist deformation and sufficiently well attached to the walls of the ducting, will eliminate the damage to the walls around the bracing. One or more internal bracings can eliminate damage throughout an entire ductwork system. Also, multiple bracings can be used to dampen a pressure wave caused by the detonation as the pressure wave travels through the ductwork. The bracing can be made from a single piece of sheet metal, as in the reinforcement panels shown in FIGS. 1 and 2. The bracing can be stamped or cut to form appropriate openings therethrough to allow for sufficient fluid flow through the flow passage inside the ductwork. In other variations, the internal bracing can simply be an individual strip or rod of metal, or other similar structure or material that can tie the opposite sides of a duct together. In the preferred embodiment, the bracing is a sheet metal piece that provides integral duct reinforcement while being flexibly attached at a flanged joint of the ductwork. The present invention is especially beneficial for use in reactor vessels with ductwork shells that are flexible, such as in U.S. Pat. No. 6,957,695. Also, the present invention allows for a bracing that can be attached to or integrated into the structure of an internal baffle, in order to provide detonation resistance to the ductwork in conjunction with such a baffle. The present invention is especially beneficial for use in reactor vessels with baffles designed to minimize the adverse effects of thermal expansion, such as in U.S. Pat. No. 7,117,934.

Based on the shape of ductwork, various configurations of internal bracing can be provided to tie and link together different wall panels. For example, in rectangular ducts, the elongated members of the reinforcement panel depicted in FIGS. 1A-1C, tie and link together the long walls of the ductwork that attached to side portions 14 and 15, but do not link the short walls of the ductwork, which are sufficiently strong to resist the detonations without reinforcement. In square ducts, a "plus" shape or grid shaped pattern of elongated members can be used to tie all of the walls about the perimeter of the duct together. Alternatively, a grid of round, elliptical or polygonal holes can be used.

Figure 3B:
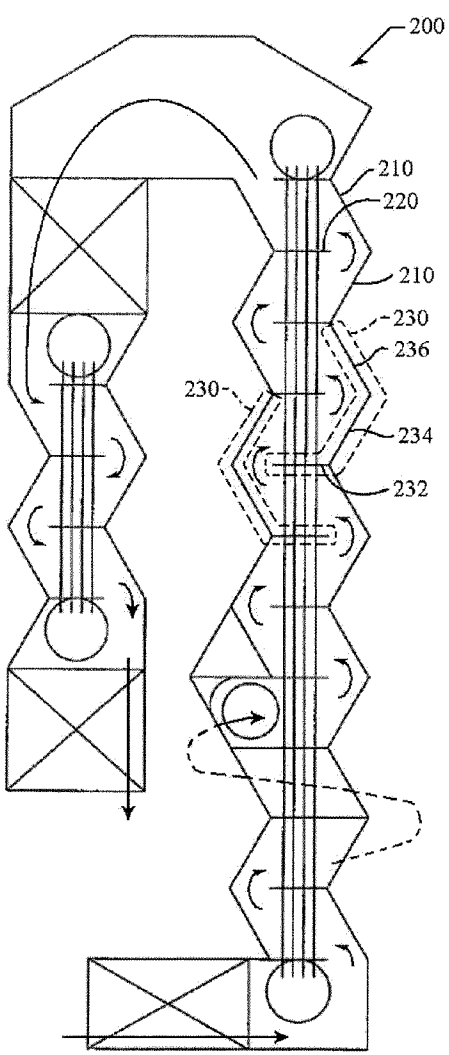
FIG. 3B depicts a cross-sectional, schematic view of an alternative embodiment of the present invention including a ductwork system having a flow path with a zig-zag configuration.
Figure 3A:
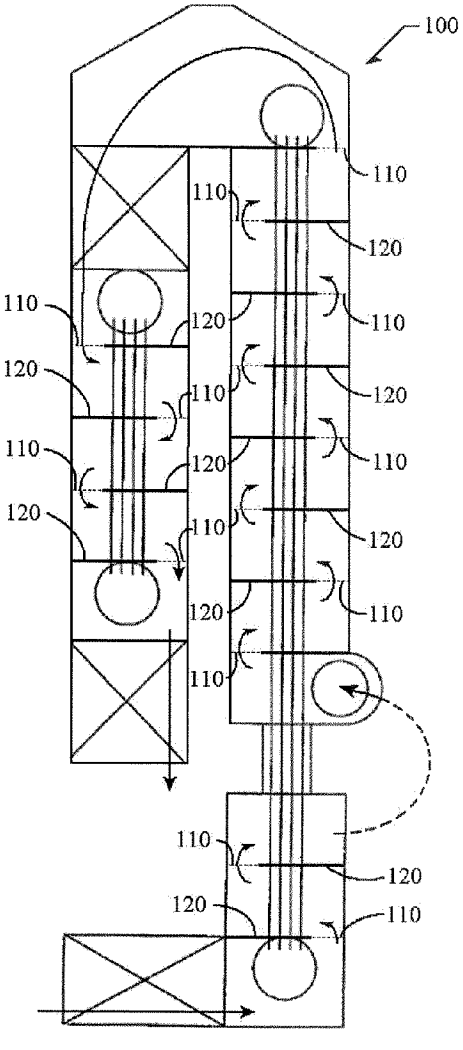
FIG. 3A depicts a cross-sectional, schematic view of an embodiment of the present invention including a ductwork system with reinforcement panels provided within the flow path, where each pass of the flow path has a rectangular cross-sectional shape.

FIG. 3A depicts a cross-sectional, schematic view of an embodiment of the present invention including a ductwork system with reinforcement panels provided within the flow path, where each pass of the flow path has a rectangular cross-sectional shape. In the embodiment of FIG. 3A, the internal bracings or reinforcement panels 110 are attached to or integrated into the structure of internal baffles 120, in order to provide detonation resistance to the ductwork in conjunction with such baffles. The internal bracings 110 in FIG. 3A are schematically depicted using dashed lines to show their locations in the ductwork, and can be provided to have an integral shape similar to the baffle and reinforcement panel shown in FIG. 4, or can be attached to the internal baffles and walls of the ductwork in any other manner. The arrows in FIG. 3A show the flow of fluid through the flow passage of the ductwork, with dashed portions of the arrows representing external piping for the fluid flow that is not depicted in the drawing.

Figure 4:
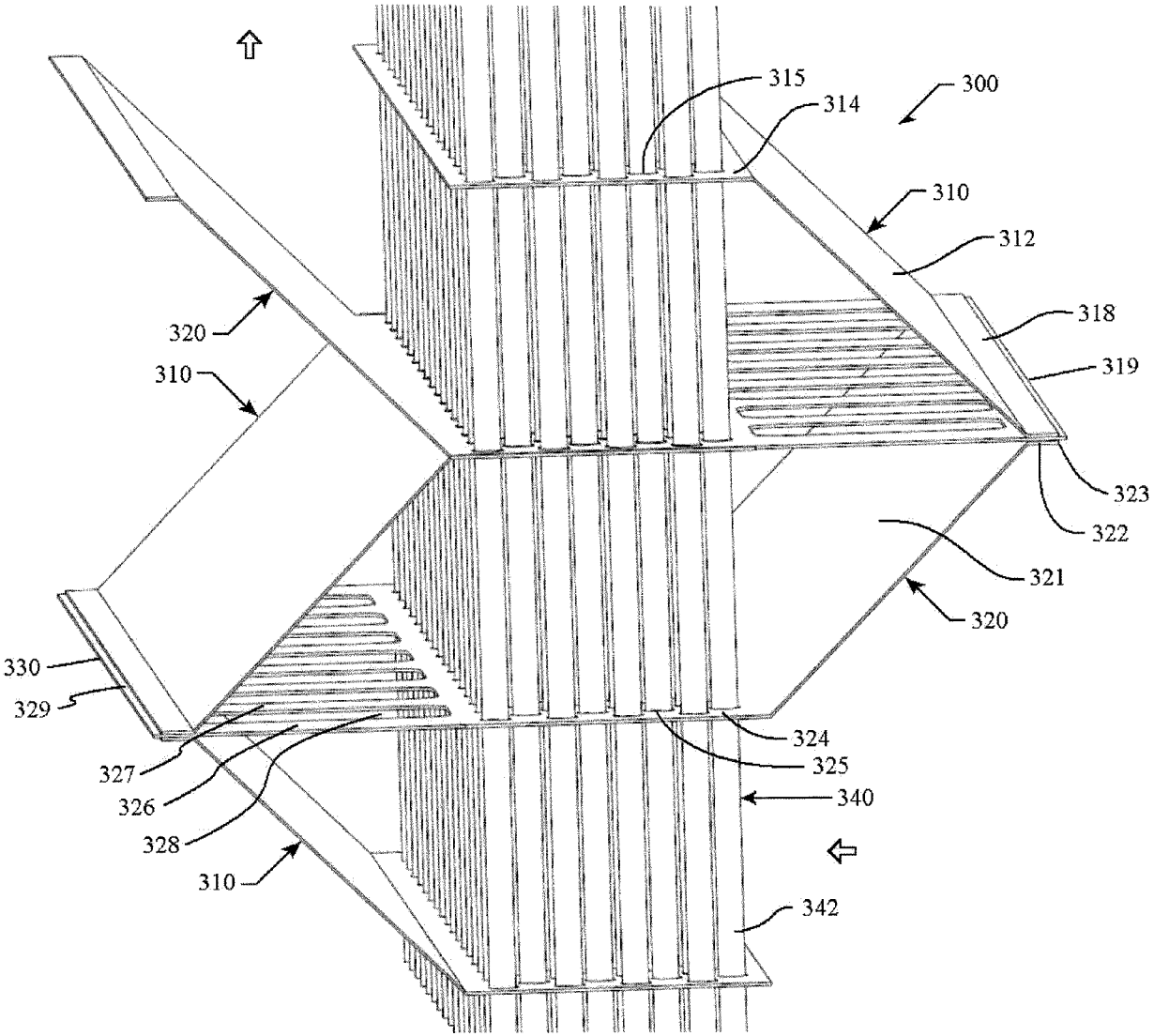
FIG. 4 depicts an enlarged, partial, perspective view (with front and rear panels removed to reveal interior structures) of a further alternative embodiment of the present invention including a ductwork system having a flow path with a zig-zag configuration in combination with reinforcement panels.
Figure 5A:
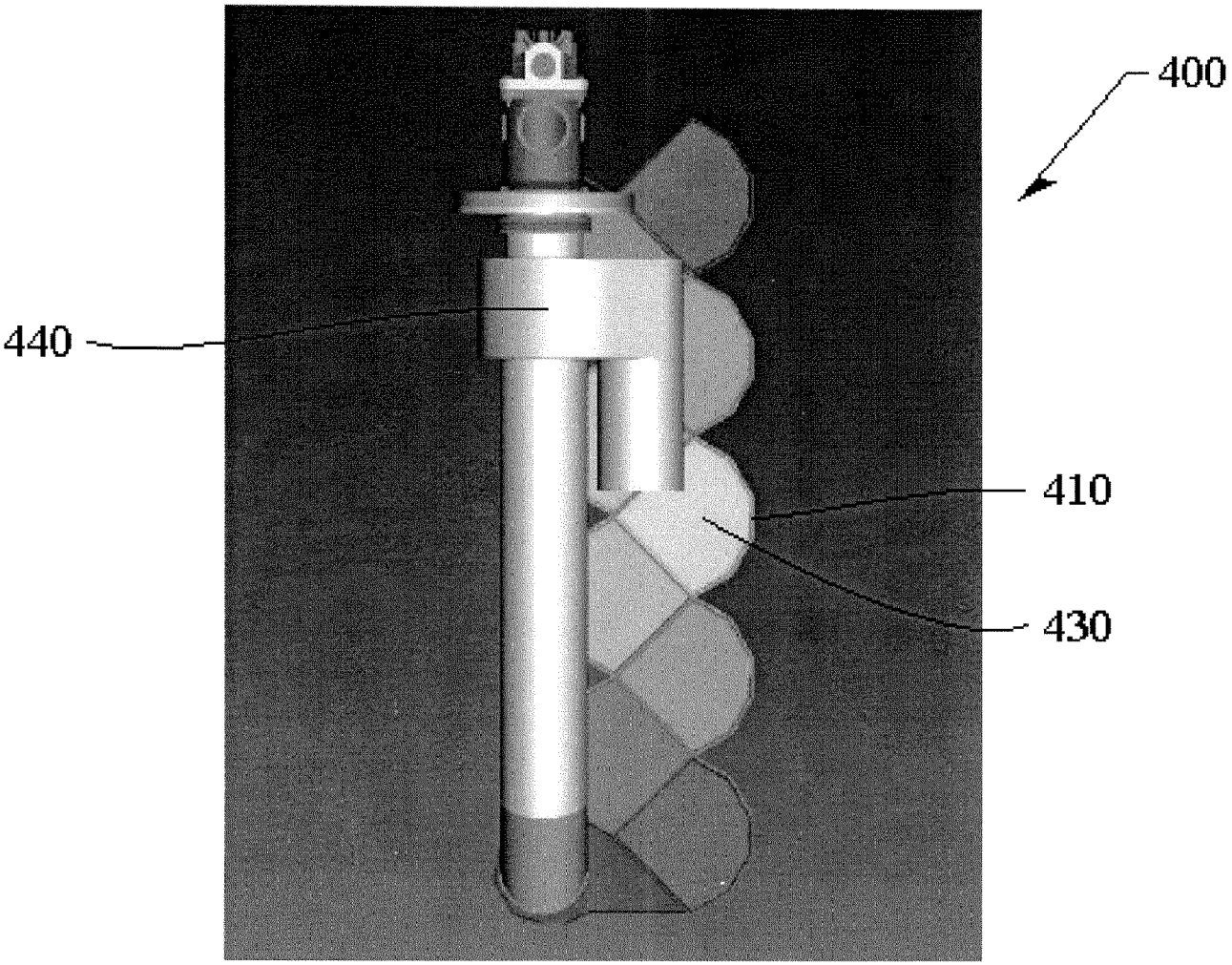
FIG. 5A depicts a front elevational view of an additional embodiment of the present invention including a ductwork system having a flow path with a repeating S-shaped configuration.
Figure 5C:
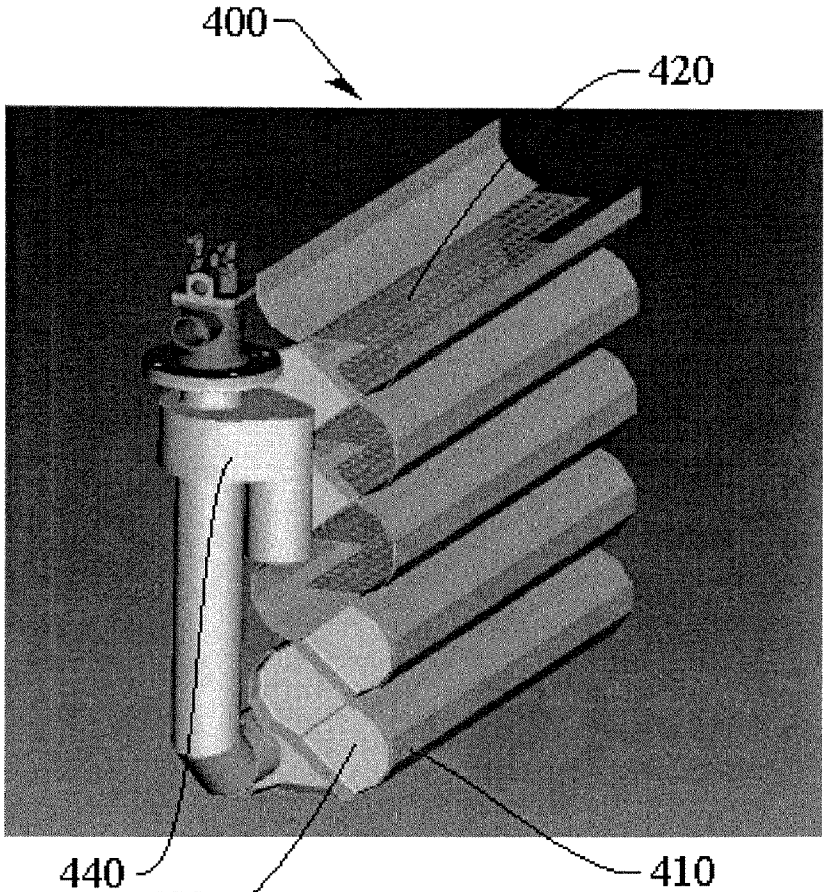
FIG. 5C depicts a perspective view of the embodiment of the present invention depicted in FIGS. 5A and 5B, with several of the front panels and the central tube bundle removed to reveal interior structures.
Figure 5B:
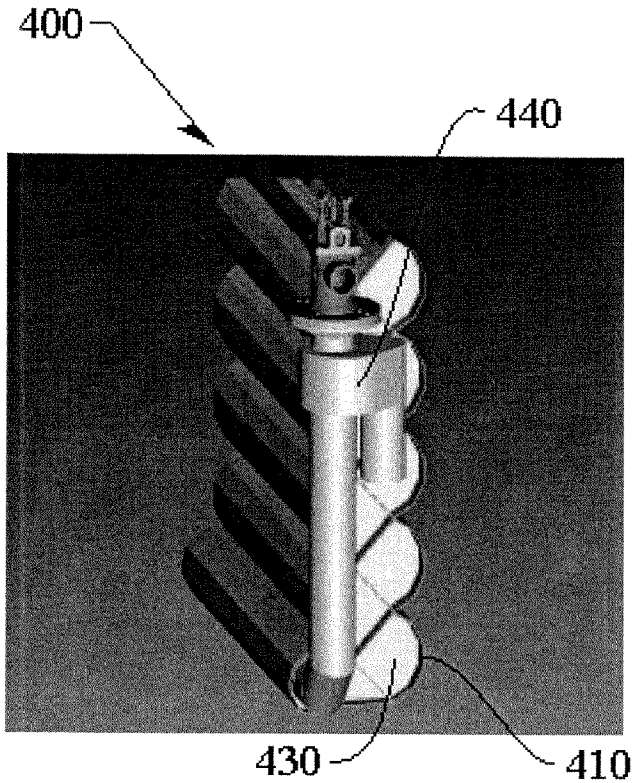
FIG. 5B depicts a perspective view of the embodiment of the present invention depicted in FIG. 5A.
Figure 6B:
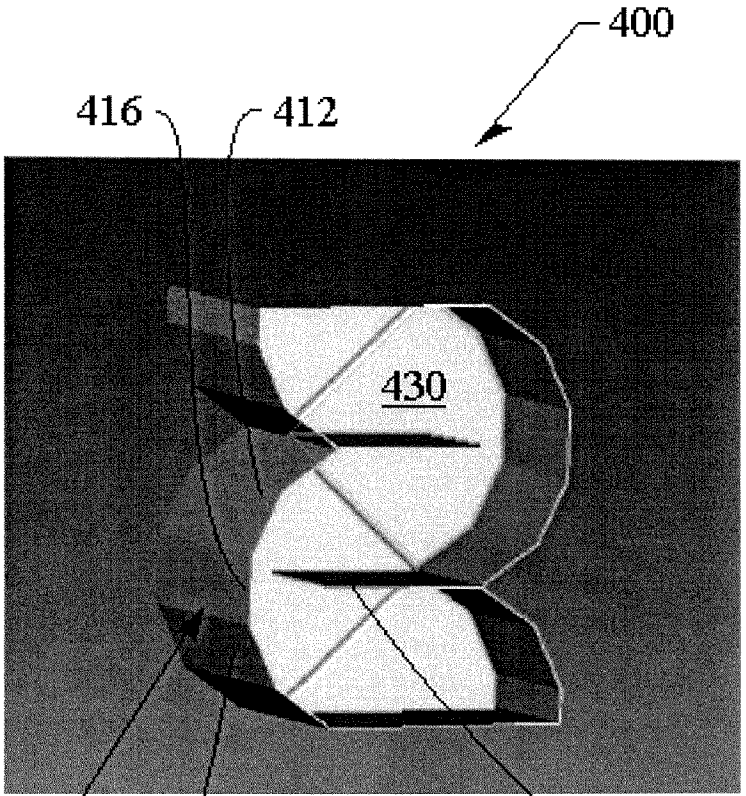
FIG. 6B depicts an enlarged, partial, perspective view of a portion of the embodiment of the present invention depicted in FIGS. 5A-5C, with all of the front panels removed to reveal interior structures.
Figure 6A:
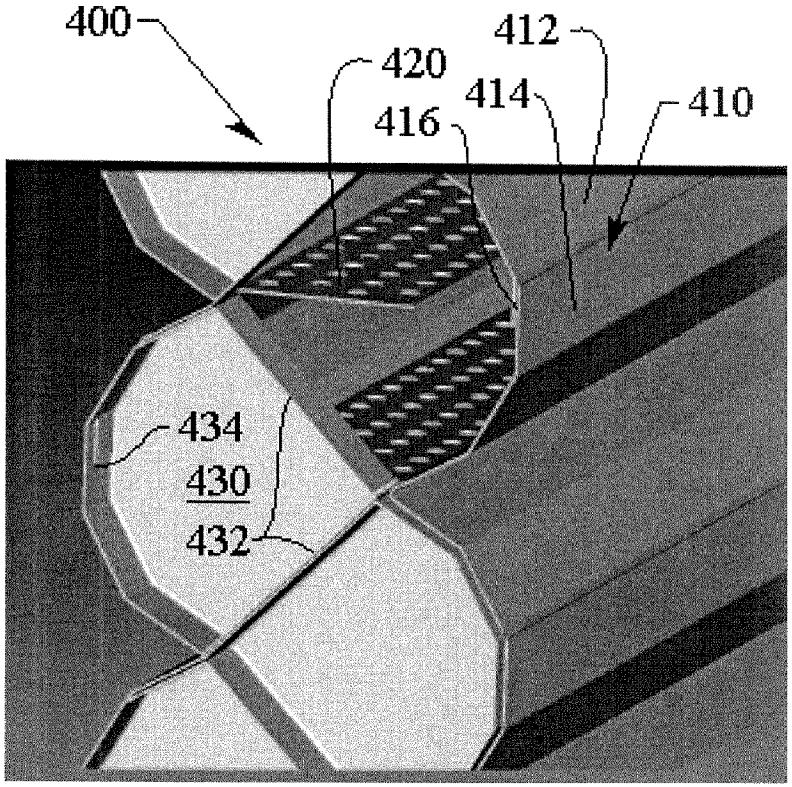
FIG. 6A depicts an enlarged, partial, perspective view of the embodiment of the present invention depicted in FIGS. 5A-5C, with a front panel removed to reveal interior structures.

FIG. 3B depicts a cross-sectional, schematic view of an embodiment of the present invention including a ductwork system that incorporates a second aspect of the present invention. Rather than using the internal bracings 110 of the embodiment in FIG. 3A, the second aspect of the invention depicted in FIG. 3B provides a ductwork system that includes ducting panels configured to resist damage from a detonation therein. (Note the two aspects of the invention can be used individually, or they can be used in combination for maximum detonation damage resistance, as depicted in FIG. 4 and described below.)

The second aspect of the invention involves providing ducting panels or walls that avoid long straight profile sections in areas most susceptible to damage during a detonation. Note that the ductwork in FIG. 3A does not include such an aspect, since the embodiment depicted therein has undesirable straight sides. Also, note that the ductwork in FIG. 2 does not include such an aspect, since the embodiment depicted therein has undesirable straight sides and straight pathways therethrough. Elimination of straight pathways will strengthen the individual walls and dampen a detonation as it travels through the duct. By using faceted sides or accordion-style cross-sections, according to the second aspect of the present invention, the span of unsupported duct wall sections that will be subjected to pressure forces caused by a detonation will be reduced. In fact, the use of hemispherical sections or faceted sections that approach or effectively achieve the ideal of a hemispherical duct section, will allow pressure forces from a detonation acting on the duct section to be evenly distributed and resisted by the duct section itself, rather than disadvantageously concentrated at specific locations within the ductwork, such as at the joints of straight sides.

FIG. 3B depicts a cross-sectional, schematic view of a ductwork system 200 having a flow path with a zig-zag configuration according to the second aspect of the present invention. The arrows in FIG. 3B show the flow of fluid through the flow passage of the ductwork, with dashed portions of the arrows representing external piping for the fluid flow that is not depicted in the drawing. Note that the sides of the ductwork are faceted due to the angled wall sections 210 used. Also, note that this aspect of the invention can alternatively be embodied in ductwork provided with an accordion-shaped cross-section by simply providing the duct with a narrow width at every other baffle 220 and a wide width at each baffle therebetween. Additionally, note that this aspect of the invention can alternatively be embodied in ductwork of having the zig-zag or accordion-shaped profile, but that do not include baffles therein.

Additionally, the second aspect of the invention can also advantageously eliminate joints by using a single piece of material 230 to form a first baffle section 232, a first ducting wall section 234, and a second ducting wall section 236, where the first ducting wall section 234 is adjacent the first baffle section 232 and a second baffle (which is adjacent to the first baffle section 232), and where the second ducting wall section 236 is adjacent to the second baffle and a third baffle (which is adjacent to the second baffle). By combining a baffle and one or more ducting wall sections into an integral piece of material and thereby eliminating joints therebetween, the ductwork system will be even more damage resistant. Advantageously, this embodiment also reduces the number of individual ducting pieces used to form the flexible ductwork system. Further advantageously, this embodiment reduces the number of joints (which were previously necessary at an upper side and a lower side of each successive pass in the ductwork in order to sandwich each baffle in between two adjacent ducting wall sections). The joints typically provide stiffness to the ductwork and disadvantageously reduce the ability of the ductwork to flex under hot operating conditions. Thus, reducing the number of joints allows the ductwork to flex and reduces stresses in the ductwork. Also, the joints provided in this embodiment are not formed from edges of the ductwork walls formed at ninety degree angles (as are the joints depicted in FIG. 2), but rather provide non-perpendicular angles that allow the joints and/or the ductwork to easily flex, thereby eliminating the triaxial stiffness and restraint of the joints used in the polygonal ductwork, for example, as shown in FIGS. 2 and 3A. Thus, if the tubular array axially expands or contracts relative to the ductwork itself during operation, the joints and ducting walls of the embodiment depicted in FIG. 3B will be able to easily flex to compensate for the change in relative dimensions of the tubular array. Thus, this embodiment reduces stress levels, while maintain or increasing the degree of flexibility of the ductwork.

For ducting surrounding a baffled tubular heat exchanger (as discussed above and depicted in FIG. 3B), the material used to form the ducting panel can also be used to integrally form a baffle, which will link the wall of the ductwork to the stiff tube bundle of the tubular heat exchanger, as shown in FIG. 3B. In such a configuration, the most damage a detonation will cause to the ductwork, will be to round out the facets of the duct.

FIG. 4 depicts an enlarged, partial, perspective view (with front and rear panels removed to reveal interior structures) of a further alternative embodiment of the present invention including a ductwork system 300 having a flow path with a zig-zag configuration in combination with reinforcement panels. The embodiment depicted in FIG. 4 combines the first and second aspects of the present invention. The arrows in FIG. 4 show the flow of fluid into and out of the flow passage of the portion of ductwork shown.

The embodiment depicted in FIG. 4 includes two configurations of ducting panels used in conjunction with one another. Ducting panels 310 are provided that include a main ducting portion 312, a baffle portion 314 having holes 315 receiving therethrough tubes 342 of a tubular heat exchanger 340, and an end portion 318 having a terminal end 319. Ducting panels 320 are also provided that include a main ducting portion 321, an end portion 322 having a terminal end 323, a baffle portion 324 having holes 325 receiving therethrough tubes the 342 of the tubular heat exchanger 340, reinforcement portion 326, and an end portion 329 having a terminal end 330. The reinforcement portion 326 acts as an internal bracing, and includes a mounting frame 326 having an opening 328 and elongated members 327.

The baffle portions 314 and 324 link the wall of the ductwork 300 to the stiff tube bundle of the tubular heat exchanger 340.

End portions 318, 322, and/or 329 that are adjacent to one another are joined using, for example, a plurality of mounting holes (not shown) provided thereon and bolt-and-nut fasteners. Additionally or alternatively, terminal ends 319, 323, and/or 330 that are adjacent to one another can be welded together to provide further structural connection therebetween. Main ducting portions that are adjacent to one another are provided such that they are at a non-zero angle to one another to provide a faceted outer profile of the duct. The joints formed in this manner provide the ductwork 300 with the ability to flex in a direction along the axial length of the tubular heat exchanger 340 without significant stresses, while providing a strong duct that can withstand and absorb forces caused by detonations within the duct without resulting in significant (or any) damage thereto.

FIGS. 5A-5C and 6A-6B depict views of an additional embodiment of the present invention including a ductwork system that incorporates the second aspect of the present invention. While this embodiment is not depicted as including internal bracings, such internals bracings can be used with this embodiment to provide further structural integrity. The ductwork system 400 depicted in FIGS. 5A-5C and 6A-6B includes ducting panels configured to resist damage from a detonation therein, and is depicted as being connected to a burner assembly 440. Internal heat exchanger tubes are not shown in the figures, but will exist in most embodiments of the invention.

The ductwork system 400 has a flow path with a repeating S-shaped configuration according to the second aspect of the present invention. The sides of the ductwork are formed using faceted or curved wall sections 410, which approximate semicircular curved portions extending around the open end of the baffles 420. Each wall section 410 can include a lower portion 412 that abuts an upper portion 414 of an adjacent wall section, such that the abutting wall sections can be joined at joint 416.

The ductwork system 400 includes front and rear panels 430 that are joined to the wall sections 410 and to adjacent panels. The panels 430 have two front edges 432 that bend outward to form a flange. The edges 432 of each panel are joined to abutting edges of adjacent panels. The panels 430 also have a faceted or curved outer edge 434 that bend outward to form a flange, which is joined to abutting wall sections that correspond therewith.

The ductwork system of the present invention improves internal pressure resistance and cycle life. The ductwork system 400 includes polygonal side, front, and rear panels, which provide a close approximation to an arcuate wall to assist with pressure loading, by approximating the stress state of a thin-walled cylinder. The side panels and baffle for each pass are made up of either two or three individual pieces that are cut and bent from sheet metal. Each baffle can be welded to the side panels for a pass above and a pass below in order to facilitate weld access to the final assembly. The arcuate front and rear end panel sections can be rosette welded to the baffles along their centerline and then joined to each other by welding along the edges of the perimeter flanges.

The reactor system will experience thermal expansion due to the use of different material and large temperature differences between the burner's inlets at the first pass to the last pass of the reactor as the gas travels to a super-heater at the outlet thereof and large temperature differences between the mean metal temperatures of the ductwork and the heat exchanger tubing. The panels of each pass can be formed of different materials along the length of the ductwork system depending upon the strength requirements are each pass and the thermal and/or corrosion conditions at each pass.

As compared to the rectangular ducting configuration depicted in FIG. 3A, for example, the ductwork system 400 does not provide as localized a stress concentration, but rather distributes the stress. In fact, calculations have shown that under normal operating conditions of a 0.7 psi pressure load the induced stresses in ductwork were negligible, and under a detonation pressure of 150 psi, the ductwork system 400 showed a maximum induced stress that was about half the magnitude of a rectangular ducting configuration.

It should be noted that the exemplary embodiments depicted and described herein set forth the preferred embodiments of the present invention, and are not meant to limit the scope of the claims hereto in any way. Numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A sheet metal duct panel for ductwork, said panel comprising: an elongated ducting panel member having a first end and a second end; said first end being configured to be attached to an end of a second elongated ducting panel member at a flanged joint;

the elongated panel member comprising three adjacent portions;

a solid first main ducting portion formed of a side ductwork panel;

a second portion adjacent to, and at a non-zero angle with the first portion, comprised of an internal baffle; and a third reinforcement portion adjacent and co-planar with the second portion, comprised of an internal bracing having a flow passage therethrough;

the second and third portions being configured to extend across an air flow passage, such that the air flow crosses through only the internal reinforcement third portion;

said elongated panel member provides integral ductwork reinforcement while being flexibly attached at the flanged joint of the ductwork;

wherein damage thereto caused by a detonation within said ductwork is resisted when a series of elongated panel members are flanged together, such that the ductwork is provided with an outer profile having a zig-zag shape; and said internal baffle plate second portion is configured to receive therethrough an array of tubes of a heat exchanger provided within the flow passage.

2. The elongated panel member according to claim 1, further comprising wherein the third reinforcement portion further comprising two or more elongated members each having a first end and a second end, said first end being configured to be attached to a flange end of the ductwork, and said second end configured to be attached to a baffle end of the ductwork opposite to the flange end of the ductwork, said two or more additional elongated members being configured to extend across the flow passage.

3. The elongated panel member according to claim 2, wherein said two or more additional elongated members are integrally formed in the third reinforcement portion panel having a first base portion integrally connected to said first ends of said two or more additional elongated members, said first base portion being configured to be attached to a first side of the ductwork.

4. The elongated panel member according to claim 3, wherein said first base portion includes a plurality of mounting holes.

5. The elongated panel member according to claim 3, wherein said panel has a second base portion integrally connected to said second ends of said elongated member and said two or more additional elongated members, said second base portion being configured to be attached to the second portion, comprised of an internal baffle, where the internal bracing portion is attached to the internal baffle portion.

6. The elongated panel member according to claim 5, wherein said first base portion and said second base portion include a plurality of mounting holes.

7. The elongated panel member according to claim 5, where in said panel includes a mounting portion that extends about an entire perimeter thereof and is configured to be attached at a flanged joint, said mounting portion includes said first base portion and said second base portion.

8. The elongated panel member according to claim 7, wherein said mounting portion includes a plurality of mounting holes.

9. The elongated panel member according to claim 5, wherein said panel is a planar sheet having elongated fluid flow openings extending therethrough, and wherein portions of said planar sheet in between adjacent elongated fluid flow openings being said elongated member and said one or more additional elongated members.

10. A ductwork system comprising: a duct having a flanged joint, and a plurality of ducting panels joined together to define a flow passage extending through said duct; and an elongated member having a first end and a second end, said first end being attached to a first ducting panel of said plurality of ducting panels and said second end being attached to a second ducting panel of said plurality of ducting panels, said elongated member extending across said flow passage, said elongated member being a sheet metal piece that provides integral duct reinforcement while being flexibly attached at the flanged joint of the ductwork wherein said ductwork includes means for resisting damage thereto caused by a detonation within said ductwork, said means for resisting damage includes providing said ductwork with an outer profile having a zig-zag shape.

11. The ductwork system according to claim 10, further comprising: a baffle having a first end attached to said first ducting panel and a second end extending within said flow passage, wherein said first end of said elongated member is attached to said second end of said baffle, thereby providing attachment of said first end of said elongated member to said first ducting panel via said baffle.

12. The ductwork system according to claim 11, wherein said baffle is configured to receive therethrough an array of tubes of a heat exchanger provided within said flow passage.

* * * * *